United States Patent [19]

Schär

[11] 4,108,388

[45] Aug. 22, 1978

[54] METHOD FOR CATCHING, SEVERING AND RETHREADING A THREAD AND AN APPARATUS FOR IMPLEMENTING THE METHOD

[75] Inventor: Hugo Schär, Dattlikon, Switzerland

[73] Assignee: Rieter Machine Works Ltd., Winterthur, Switzerland

[21] Appl. No.: 674,655

[22] Filed: Apr. 7, 1976

[30] Foreign Application Priority Data

Apr. 16, 1975 [CH] Switzerland ..... 4830/75

[51] Int. Cl.[2] ..... B65H 67/04; B65H 54/26

[52] U.S. Cl. ..... 242/18 DD; 242/18 R; 242/18 PW; 242/19; 242/35.5 A

[58] Field of Search ..... 242/18 DD, 18 R, 18 A, 242/19, 35.5 A, 18 PW, 41, 35.5 R

[56] References Cited

U.S. PATENT DOCUMENTS

| | | | |
|---|---|---|---|
| 3,791,126 | 2/1974 | Kose et al. | 242/18 R UX |
| 3,820,730 | 6/1974 | Endo et al. | 242/35.5 R |
| 3,915,398 | 10/1975 | Corl | 242/18 DD X |
| 3,948,452 | 4/1976 | Burysek et al. | 242/18 A |

*Primary Examiner*—Stanley N. Gilreath
*Attorney, Agent, or Firm*—Werner W. Kleeman

[57] ABSTRACT

A method of and apparatus for catching, severing and sucking-off a continuously arriving thread and rethreading said thread onto a new empty bobbin tube, wherein the thread is caught in the zone of a thread traversing triangle, severed and continuously sucked off, retracted from the zone of the bobbin package and after the bobbin change the thread is inserted into the bobbin tube and the incoming thread is taken up by the bobbin tube and simultaneously is severed from the thread end extending to the suction device.

12 Claims, 3 Drawing Figures

METHOD FOR CATCHING, SEVERING AND RETHREADING A THREAD AND AN APPARATUS FOR IMPLEMENTING THE METHOD

BACKGROUND OF THE INVENTION

The present invention concerns a new and improved method of catching a continuously incoming thread, severing said thread, sucking-off the thread, and rethreading said thread onto an empty bobbin tube, and the invention further pertains to improved apparatus for implementing the aforesaid method.

In the German petty Pat. No. 7,312,039 there is disclosed a device for catching and sucking-off threads which contains a fixed suction nozzle, an outer cutting element movable forward parallel to the suction nozzle, and a cutting device located inside the suction nozzle.

This known device is manually held and the thread is caught by it above the thread traversing triangle. By activating the outer cutting element the thread is severed and sucked-off and after the bobbin change is effected is rethreaded onto the empty bobbin tube, and the thread end extending to the nozzle is severed by activating the inner cutting device.

When using this device a bobbin change can be effected by hand, however, its use in conjunction with automatic bobbin change devices cannot be considered, as the thread cannot be caught in the zone of the thread traversing triangle in close vicinity to the bobbin package and for the complete bobbin change process a plurality of manipulations must be executed which reduce the reliability and furthermore necessitate a complicated control unit.

SUMMARY OF THE INVENTION

Hence, it is a primary object of the present invention to render possible the catching of the thread in a simple manner, to sever the thread and to take up the thread coming in during the bobbin change and to rethread this thread end onto the empty bobbin tube after the bobbin change.

This is achieved by a method characterized in that the thread is caught in the zone of the thread traversing triangle, severed and continuously sucked-off, retracted from the zone of the bobbin package and after the bobbin change such thread is inserted into the bobbin tube and the incoming thread is taken-up by the bobbin tube and simultaneously is severed from the thread end extending to the suction device.

A further object of the present invention is to implement the method using an apparatus which is of simple design, reliable in operation and economically feasible to manufacture.

According to the invention the apparatus is characterized in that the catching and severing device is provided in the immediate vicinity of the suction orifice of the suction device and can be driven throughout the whole catching, severing and rethreading process.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE INVENTION

Figure 1:
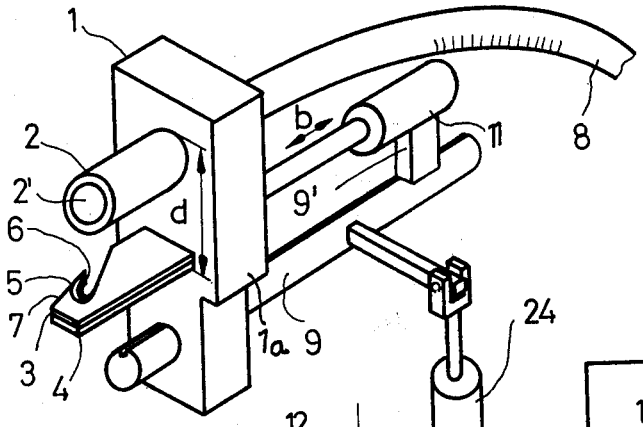
FIG. 1 is a perspective view of a thread catching and severing apparatus.

Referring now to the drawings there is shown in FIG. 1 a thread catching and severing device or apparatus—generally hereinafter designated simply as apparatus—comprising a drive section or means 1, a suction nozzle 2 and mutually contacting cutters or knives 3, 4. These knives 3, 4 are each provided on one side with a respective substantially drop-shaped or tear-shaped recess 5, 6 and adjacent thereto with a thread guide surface 7 extending towards the front. The lower knife 4 is arranged to be slidingly movable on the upper knife 3 whereas the upper knife 3 is fixedly arranged. Of course the arrangement of the knives 3 and 4 also could be reversed. The traversing movement or stroke of the knife or cutter 4 at least corresponds to the largest extent or width of the recess 5. Above the knives there is arranged the suction nozzle 2 for sucking-up the thread during the bobbin change process, the nozzle orifice or mouth 2' of which ends above the recess 5. In the drive section or means 1 there is also located the drive, schematically indicated by reference character 1*a*, generating the longitudinal movement of the lower knife 4 as well as a connection 8 to any suitable external source 50 (FIG. 2) of compressed air for the suction nozzle 2 with its opening 2' and the knife drive 1*a*. The longitudinal movement of the knife 4 is effected by a drive means 1*a* in the form of a pneumatic motor supplied with compressed air from the same source 50 of compressed air as the suction nozzle 2 of the suction device. Both units, the drive of the knife 4 and the suction nozzle 2 operate throughout the whole bobbin change process from its beginning to its end, i.e. the supply of compressed air commences as the bobbin change process starts and is correspondingly stopped as the bobbin change process is terminated.

Figure 2:
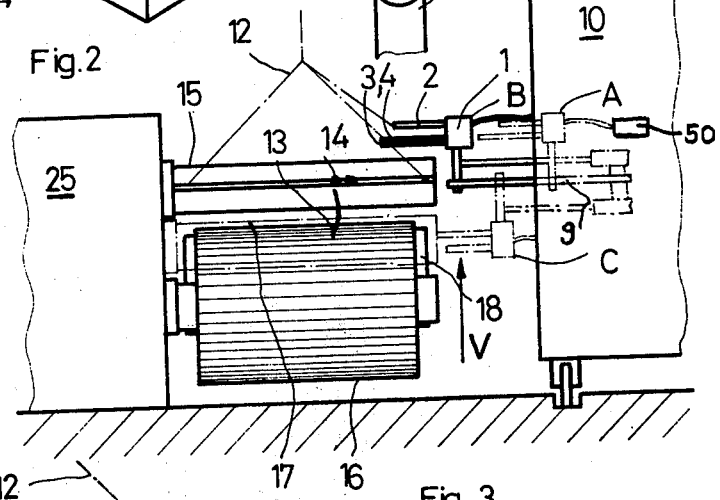
FIG. 2 illustrates the apparatus according to FIG. 1 on a bobbin change apparatus.

A guide element 9 is rotatably supported in a movable bobbin change apparatus 10 (partially shown in FIG. 2). This bobbin change apparatus 10 may comprise the bobbin change apparatus disclosed, for example, in U.S. Pat. No. 4,052,017 entitled Method and Apparatus For Automatically Changing Textile Bobbins on a Cantilevered Bobbin Chuck of a Textile Winding Machine. A pneumatically driven piston and cylinder unit 11 is rigidly connected with the guide element 9 via the support 9' and can move the drive section 1 in longitudinal direction *b* on the guide element 9 from a starting position or idling position respectively, indicated by reference character A (Fig. 2) to a catching position B in the thread traversing triangle of the thread 12.

In FIG. 2 the apparatus is shown built into a bobbin change apparatus 10 in its catching and cutting position B where the free ends of the knives 3, 4 are located within the thread traversing triangle indicated with phantom or dash-dotted lines, and in which position the traversing thread 12 of course is immediately severed and the still incoming end of the thread is sucked into the suction nozzle 2. The cut-off end 13 of the thread 12, after being severed, glides out of the traversing thread guide 14 of the thread traversing device 15 to a bobbin package 16. The drive section of the winding machine, which is only partially visible, is designated by reference character 25.

For pivoting or rotating the guide element 9 a piston 24 is provided within the bobbin change apparatus 10, which downwardly pivots the guide element 9 including the drive section 1 into a rethreading position C.

This position C is indicated in FIG. 2 with dash-dotted lines, i.e. the position maintained while the thread is rethreaded onto an empty bobbin tube 17 which has just been accelerated by a friction drive drum 18.

Figure 3:
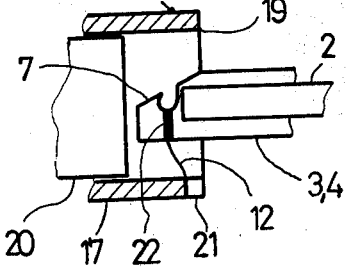
FIG. 3 is a section of a bobbin tube and the catching and severing apparatus viewed in the direction of the arrow V according to FIG. 2.

The apparatus with its knives 3, 4 and with the opening or orifice 2' of the suction nozzle 2 partially extends into the open end 19 of the bobbin tube 17, for which purpose also the outer or maximum distance *d* between the knives 3, 4 and the suction nozzle 2 is smaller than the bobbin tube-inside diameter. In FIG. 3 the apparatus is shown in fragmentary view on an enlarged scale in its rethreading position C. Apart from there being visible the bobbin tube 17, there also will be seen part of a bobbin chuck 20 and a radial incision or cut-out 21 at the bobbin tube end 19. The knives 3, 4 and the suction nozzle 2 have their end portions somewhat inserted into the bobbin tube 17. At the knife or cutter 3 there is also visible the thread guide surface 7 formed for instance by lateral bevelling. The thread 12 extending from the suction nozzle 2 to the incision or cut-out 21 is wrapped around the knives 3, 4 in wraps 22.

The steps of the method of catching, severing and rethreading a thread are effected in the following sequence of operating steps:

As the bobbin package 16 is built up to the desired size, the drive section 1 with the suction nozzle 2 and the knives 3 and 4 is moved from its starting position A out of the automatic bobbin change device 10 in the plane formed by the thread traversing triangle towards the traversing thread 12 into its catching position B. As the knives 3, 4 reach a position within the thread traversing triangle the thread 12 slides over the thread guide surface 7 into the recesses 5 and 6 of the knives 3 and 4. The recesses 5, 6 thus also are used as a catching zone. Simultaneously with the start of the outbound movement of the apparatus the oscillating drive of the knife 4 and the suction in the suction nozzle 2 also have been started. The thread 12 is severed by the relative movement of the two knives 3 and 4 in the recesses 5 and 6. The thread coming in or the thread moving on cannot jam on the knives 3, 4 as the relative movement of the knives is maintained, as mentioned before, throughout the duration of the entire catching, severing and rethreading process. The thread 12 still coming in at high speed now is sucked-off via the suction nozzle 2.

After this first step, i.e. the catching and severing of the thread 12 there is now initiated the rearward movement of the apparatus to the starting position A. Now the full bobbin package 16 is exchanged against an empty bobbin tube 17 by the bobbin change device.

The second step, i.e. the rethreading of the thread and the renewed severing of the thread end, is effected as follows: The apparatus is pivoted and thus positioned in front of the empty bobbin tube 17 which is already accelerated and axially moved forward to such an extent that the thread 12 moving into the orifice or mouth 2' of the suction nozzle 2 contacts the face end of the bobbin tube 17 and is engaged by the radial incision or cut-out 21. During this process, due to the high rotational speed of the bobbin tube 17 and the relatively low frequency of the knife movement, some few wraps may be formed around the knives 3, 4 by the thread still moving into the suction nozzle 2. The permanent oscillating movement of the knives, however, again cuts these wraps 22 and the severed thread rests or remains which are thus formed are sucked-off by the suction nozzle 2. A very short thread piece end remains on the inside of the bobbin tube 17, the length of which is about half of the bobbin tube diameter. Now the apparatus is brought back to the starting position A and simultaneously the suction, as well as the knife drive, are switched off.

The advantages of the present invention are seen mainly in the simplification of the apparatus for implementing the method and the resulting reliability of operation which, in the application of automatic bobbin change devices, is of decisive importance; one single thread not severed or not sucked-off causes downtime of the whole bobbin change device until an operator has manually eliminated the disturbance.

A further advantage resides in the fact that the path to be covered by the apparatus between the catching position B and the rethreading position C is at a minimum, so that considered from the construction aspects of the equipment or designwise it is possible to realize the path displacement merely by pivoting and with the use of most simple means.

Of course a plurality of such apparatuses can be provided for an automatic bobbin change device, each individual apparatus again being provided for a plurality of winding positions. There also is the possibility of providing each individual winding position with an apparatus of this type.

A further advantage of the present invention is that one single permanently driven thread severing device reliably severs the thread after the thread has been caught and after the thread has been rethreaded, and this device at the same time is self-cleaning owing to the permanent knife drive during the entire catching, severing and rethreading process. A simple control unit in the bobbin change device is sufficient for activating the functional operating steps entailing forward movement, retraction and pivoting of the apparatus.

While there are shown and described present preferred embodiments of the invention, it is to be distinctly understood that the invention is not limited thereto, but may be otherwise variously embodied and practiced within the scope of the following claims. Accordingly,

What is claimed is:

1. A method of catching, severing and sucking-off a continuously arriving thread and rethreading said thread onto a new empty bobbin tube, comprising the steps of:

continuously infeeding a thread onto a bobbin tube to form a bobbin package thereon while the thread moves through a thread traversing triangle;

building-up the bobbin package by means of an infed thread on the bobbin tube;

displacing a common thread catching and severing device having knife blades into the zone of the thread traversing triangle when the bobbin package is built-up to a desired size;

initially catching the thread with the knife blades of the common thread catching and severing device within the zone of the thread traversing triangle;

holding and severing the thread by means of the knife blades of the common thread catching and severing device;

continuously sucking-off the incoming thread end by means of a suction device;

retracting such thread end from the zone of the built-up bobbin package;

carrying out a bobbin tube change by removing the built-up bobbin package and inserting a new empty bobbin tube;

following the bobbin tube change laterally inserting the thread end into the new empty bobbin tube;

engaging the thread by means of the new empty bobbin tube;

simultaneously severing the thread with the knife blades from the thread end extending to the suction device when the incoming thread has been positively caught by the new empty bobbin tube; and thereafter shifting the common thread catching and severing device back into an idle position.

2. A method of catching, severing and sucking-off a continuously arriving thread and rethreading said thread onto a new empty bobbin tube, comprising the steps of: in the zone of a thread traversing triangle, initially catching the thread with knife blades of a common thread catching and and severing device holding and severing the thread with the knife blades and continuously sucking-off the thread end by a suction device, retracting such thread end from the zone of a built-up bobbin package, carrying out a bobbin change, after such bobbin change laterally inserting the thread end into an empty bobbin tube, engaging the inserted thread by means of the bobbin tube, and simultaneously severing the thread with the knife blades from the thread end extending to the suction device when the arriving thread is positively engaged by the empty bobbin tube.

3. The combination with an automatic thread winder for winding-up a continuously arriving thread onto a bobbin tube to form a bobbin package thereon and a bobbin change apparatus for removing the built-up bobbin package and inserting a new bobbin tube onto which there is to be formed a new bobbin package, of an apparatus for catching, severing and sucking-off the continuously arriving thread and rethreading such thread onto the new bobbin tube, said apparatus comprising:

a common thread catching and severing means having knife blades for initially catching and severing the continuously arriving thread as it is wound-up onto the bobbin tube while moving through a thread traversing triangle;

suction means provided with a suction opening cooperating with the common thread catching and severing means;

said knife blades being provided with a common guiding, catching and severing zone;

said common guiding, catching and severing zone being located at the vicinity of the suction opening;

means for supporting and enabling displacement of the common thread catching and severing means into the zone of the thread traversing triangle, for retracting said common thread catching and severing means from the zone of the thread traversing triangle after the continuously arriving thread has been severed by the knife blades of said common thread catching and severing means and the thread end sucked-off by the suction means and, following the bobbin tube change operation, for enabling the common thread catching and severing means together with the sucked-off thread end to be displaced into an end face of the new bobbin tube where the thread is rethreaded onto the new bobbin tube and simultaneously severed by the knife blades after rethreading; and means for driving the common thread catching and severing means throughout the entire catching, severing, sucking-off and rethreading processes.

4. The apparatus as defined in claim 3, wherein the knife blades comprise two knives mounted for sliding contact with one another and movable relative to one another.

5. The apparatus as defined in claim 4, further including drive means for driving at least one of said two knives.

6. The apparatus as defined in claim 3, wherein the knife blades includes means defining a catching zone.

7. The apparatus as defined in claim 6, wherein the catching zone possesses a substantially drop-shaped recess.

8. The apparatus as defined in claim 6, wherein the means defining the catching zone comprises said knife blades defining a pair of coacting relatively movable knives, at least one of said knives being provided with a thread quide zone.

9. The apparatus as defined in claim 8, wherein the thread guide zone comprises a lateral bevelled portion of said one knife.

10. The apparatus as defined in claim 3, wherein the suction means includes a suction nozzle provided with the suction opening, the knife blades including a pair of relatively movable knives, said driving means driving at least one of said knives and means for commonly supplying compressed air from the same source to said driving means for one of the knives and the suction nozzle.

11. The apparatus as defined in claim 3, wherein said suction means comprises a suction nozzle provided with said suction opening, said knife blades comprising a pair of relatively movable knives, the outer distance between said knives and the suction nozzle being smaller than the inside diameter of the bobbin tube onto which there is wound the thread.

12. In a winding apparatus having means for winding thread onto a bobbin tube and means for carrying out a bobbin tube change operation, an apparatus for catching, severing and sucking-off a continuously arriving thread as it is wound-up onto said bobbin tube while moving through a thread traversing triangle and rethreading such thread onto a new bobbin tube, comprising a common thread catching and severing device, a suction means with a suction opening provided on said common thread catching and severing device, said common thread catching and severing device having knife blades provided with a common guiding, catching and severing zone for initially catching the thread in the thread traversing triangle and severing the thread, said common guiding, catching and severing zone being located at the immediate vicinity of the suction opening, supporting elements for supporting and forwarding said common thread catching and severing device in and retracting said common thread catching and severing device from the zone of the thread traversing triangle and after a bobbin tube change for forwarding the common thread catching and severing device with the sucked-off thread end into a face side of the bobbin tube and for retracting the common thread catching and severing device into an idle position after rethreading and simultaneously severing the thread with the knife blades, and means for driving the common thread catching and severing device throughout the entire catching, severing, sucking-off and rethreading process.

* * * * *